US005650806A

United States Patent [19]

Denne

[11] Patent Number: 5,650,806

[45] Date of Patent: Jul. 22, 1997

[54] INK JET NOZZLE/VALVE, PEN AND PRINTER

[75] Inventor: William Anthony Denne, Cambridge, England

[73] Assignee: Domino Printing Sciences PLC, England

[21] Appl. No.: 349,701

[22] Filed: Dec. 5, 1994

Related U.S. Application Data

[63] Continuation of Ser. No. 768,192, filed as PCT/GB90/00477, Mar. 30, 1990 published as WO90/12691, Nov. 1, 1990, abandoned.

[30] Foreign Application Priority Data

Apr. 17, 1989 [GB] United Kingdom ..... 8908627
Apr. 18, 1989 [GB] United Kingdom ..... 8908737

[51] Int. Cl.[6] ..... B41J 2/01

[52] U.S. Cl. ..... 347/20; 347/54; 347/68; 401/156

[58] Field of Search ..... 347/11, 47, 44, 347/54, 68, 20; 401/145, 148, 152, 156, 158, 163, 183, 184, 264, 232, 235

[56] References Cited

U.S. PATENT DOCUMENTS

| | | | |
|---|---|---|---|
| 378,742 | 2/1888 | Underwood | 401/156 |
| 2,014,149 | 9/1935 | Stafford | 401/156 |
| 2,063,892 | 9/1936 | Beck | 401/133 |
| 2,287,209 | 6/1942 | Weiss | 401/156 |
| 3,693,843 | 9/1972 | Perry et al. | 222/490 |
| 4,201,491 | 5/1980 | Kohler | 401/148 |
| 4,284,996 | 8/1981 | Greve | 347/11 |
| 4,395,719 | 7/1983 | Majewski et al. | 346/140 R |
| 4,762,433 | 8/1988 | Bergeson et al. | 401/186 X |
| 4,997,301 | 3/1991 | Sheu | 401/156 |

FOREIGN PATENT DOCUMENTS

| | | | |
|---|---|---|---|
| 0072685 | 2/1983 | European Pat. Off. . | |
| 2714344 | 8/1978 | Germany . | |
| 272263 | 10/1989 | Germany | 347/54 |
| 57-95511 | 12/1983 | Japan . | |

*Primary Examiner*—John E. Barlow, Jr.
*Attorney, Agent, or Firm*—Venable, Baetjer, Howard & Civiletti, LLP

[57] ABSTRACT

An ink jet printer or a pen has a nozzle or valve (4) formed by an orifice in an elastic material (1), and the orifice comprising a slit or hole (9) in the elastic material deformable to cause the slit or hole to open or close to eject ink (2) under pressure. The printer preferably has plural, closely spaced nozzles and actuators in the form of a piezoelectric unimorph (10).

15 Claims, 6 Drawing Sheets

INK JET NOZZLE/VALVE, PEN AND PRINTER

This application is a continuation of application Ser. No. 07/768,192, filed as PCT/GB90/00477, Mar. 30, 1990 published as WO90/12691, Nov. 1, 1990, now abandoned.

The present invention relates to ink jet nozzles for use in ink jet printers or writing instruments such as pens. More particularly, as concerns printers, the invention relates to ink jet printers of the drop-on-demand type in which ink droplets are selectively emitted under pressure through a row of nozzles.

It is known for a series of solenoid valves to open and close the plural nozzles selectively so that an ink droplet is only emitted from a nozzle when a dot is required to be printed. Such a printer is described in GB-B-2134452.

However, a wide range of valve operated drop-on demand printers exists, one type which uses solenoid operated valves being used to print relatively large characters. It has also been proposed to use valve actuators comprising piezoelectric materials, operating plungers, cantilevered closure arms or the like for example. Office printers may be of the open orifice type in which ink is ejected by a hydraulic pressure within the ink. This may be generated by a piezoelectric diaphragm or by localised heating of the ink.

High speed ink jet printers are usually of the so called "continuous type" in which a stream of ink droplets is continuously emitted from a nozzle, the droplets which are to be printed being charged and then deflected to a chosen print position by electrostatic forces, and droplets which are not required robe printed passing directly to a gutter and being recirculated. The control mechanisms for such continuous ink jet printers are therefore complicated and, as a direct consequence, the selling price of a single printhead continuous ink jet printer is very high in comparison with that of a drop-on-demand printer. However, such printers are typically used to produce small characters or rows of characters generally less than about 5 mm in height. Increasing the number of nozzles in order to produce larger characters, inevitably further complicates the control mechanism.

There is a need therefore for an ink jet printer which is capable of being used to print small, medium and large characters using the same technology, in order to enable the benefits of modularity to be achieved and to enable a single control system to be used across a range of printers using different size characters. It is also desirable that a single printer be usable to print characters of different sizes.

Although the ability to print characters of different sizes can, in part, be achieved by means of continuous ink jet printers, the range of sizes is strictly limited. Other attempts at allowing variable sized characters to be printed have been made using drop-on-demand printers by allowing the nozzle assembly to be adjusted in position relative to the material in which the characters are required to be printed, in order to change the angle at which the droplets impinge on the material and thus alter the height. However, again, the size of the characters which can be printed using such techniques is strictly limited.

A variety of means are employed in the construction of pens and similar writing instruments for depositing ink on the writing surface, but a general requirement is that a fine and uniform line be produced with great consistency and low writing pressure.

The present invention has the object of providing a nozzle which is usable in both printers and pens to provide the particular requirements of both.

According to the invention, there is provided a combined nozzle and valve for an ink jet printer or writing instrument, the nozzle/valve having an orifice in an elastic material, the orifice being pre-loaded in compression to cause the orifice to be normally sealed, and a slit or hole in the elastic material, the elastic material being pre-loaded in compression to cause the orifice to be normally sealed, and controllably deformable to cause the orifice to open.

Preferably, the ink jet printer has an ink chamber for containing ink, the nozzle/valve being formed in a wall of the chamber, through which a jet of ink is issued in use for printing on a surface; and, an actuator engaging the elastic material and operable to cause it to deform so as to open or close the slit or hole.

The ink chamber may be pressurised, for example from an ink reservoir which is itself put under pressure by say an air-pressurised diaphragm, but other methods of pressurising the chamber may be employed. The ink chamber may be self-pressurising in use as a result of the deformation of the chamber walls.

Preferably, the actuator is a piezoelectric transducer, more preferably, a unimorph type piezoelectric element.

The orifice may be formed by piercing the elastic material from which the wall of the chamber is made, or by moulding it around an appropriate former, the puncture or aperture being in the form of a slit or hole or system of slits or holes. The slit or hole in the elastic material effectively forms a valve which can be operated by lateral expansion or compression of the portion of the elastic material around the slit.

Preferably the orifice in the elastic material is tapered to reduce loss of head through viscous drag effects, the minimum cross-section of the orifice being provided at the outer surface of the elastic material and the profile of the taper being designed appropriately.

If a linearly tapering slit or orifice is used then, because of the law of conservation of mass, the mean ink velocity through a given section of the orifice will be inversely proportional to the cross-sectional area, and assuming similarity of cross-section the velocity will be inversely proportional to the square of the slit width. Since viscous drag is proportional to the velocity gradient which in turn is inversely proportional to slit width, the incremental loss of pressure will be inversely proportioned to the cube of the slit width and the pressure distribution along the slit will therefore follow a quartic law which may effectively limit loss of head to within a few slit widths of the orifice. This effect can be exaggerated if required by use of a higher order curvature of the taper so that a tapered elongate orifice through a thick elastic wall may provide a lower pressure loss than a parallel sided orifice through a thin membrane. Furthermore, the thickness of the barrier may be used to provide the rigidity required for directional control of the jet and the space to incorporate the actuator. The length of the orifice may also assist in establishing stable jet flow.

A system of slits in an elastic material may conveniently be produced by transfixing the material against a thin elastic substrate mounted on a rigid base, with a pointed blade of appropriate taper. A single or two edged blade, for example, may be used to provide a planar slit and a three facetted point can provide three planar slits intersecting along the axis of the orifice. The diameter of the orifice can be controlled by the depth of penetration of the piercing blade through the elastic barrier and this can be achieved by appropriate choice of blade sharpness, penetration depth, material thickness and elastic modulus. Very fine orifice dimensions may be produced with great consistency therefore.

To provide a slit between an elastic material and a rigid surface the surface may be coated with a release agent at the appropriate location and the elastic material bonded to the surface except where coated. Alternatively, the elastic material may be pierced with a blade of asymmetric cross-section such that the cutting device automatically tends towards the rigid surface when producing the slit.

In order to open and close the orifice a variety of means may be used, but radial or planar compression in the plane of the elastic material around the orifice will cause the orifice to close and expansion will open it, thus providing, in effect, a valve to control ink flow.

Compression may be applied directly to the lateral aspects of the orifice with a simple push-pull transducer system, but, alternatively, the ink pressure may be allowed to distend the elastic material as a deflected beam, bridge or plate, so producing compression of the slit. In this fashion the closure pressure can be related directly to the ink pressure and by correct choice of geometry may always be arranged to significantly exceed ink pressure. The orifice may be opened by applying an opposing pressure to create tension across the slit and it may be arranged to open from the inner aspect of the orifice and close from the outer aspect. This effect can be significantly enhanced by providing the appropriate profile to the elastic material wall.

The inner surface of the wall may be ridged or domed around the orifice or orifices so that it effectively hinges from the periphery of the ridge or dome. This geometry may provide additional mechanical advantage for ink pressure to close the valve.

A number of advantages result from the preferred embodiments of the present invention. Firstly, the orifice is able to be positively closed when it is not passing ink and this will prevent or reduce the drying of ink in the orifice and clogging of it with ink pigment. Secondly, since the ink jet may open the orifice from the inside to the outside, and because a taper may be provided to ensure low viscous losses, the full driving pressure is substantially instantly available at the orifice when the printer is switched on. This is significant, for a low ink flow rate will produce overflow which generates an ink drop on the outer face of the elastic wall which obscures the orifice. This drop not only impedes the formation of a stable jet, but may also influence the initial direction of the jet or even inhibit jet formation entirely. Because of the tapering section of the slit it is possible to set up conditions whereby initial ink flow into the open slit results in the formation of a shock front. The surge of pressure resulting from the shock front, at the opening of the orifice, may ensure a clean start to the jet and assist in clearing debris that may have accumulated—by distension of the slit. Positive closure of the valve provides a high pressure to exude remaining ink from the slot. The termination of the jet may therefore be arranged to be as precise as initiation and there will be no gradual reduction in flow producing a residual ink drop on the outer surface of the wall around the orifice.

One or more orifices may be provided in a single elastic wall, with a corresponding number of respective actuators or plural orifices with a single actuator—e.g. for bar code printing.

Examples of printing devices constructed with nozzles in accordance with the present invention will now be described with reference to the accompanying drawings in which.

Figure 10A:
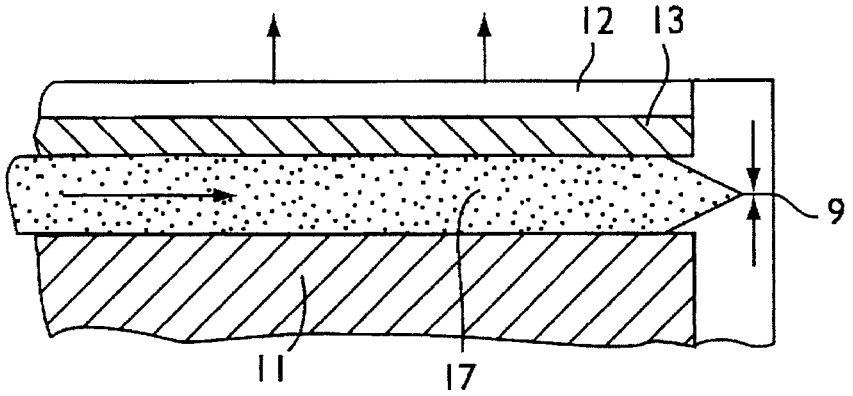
Figure 11:
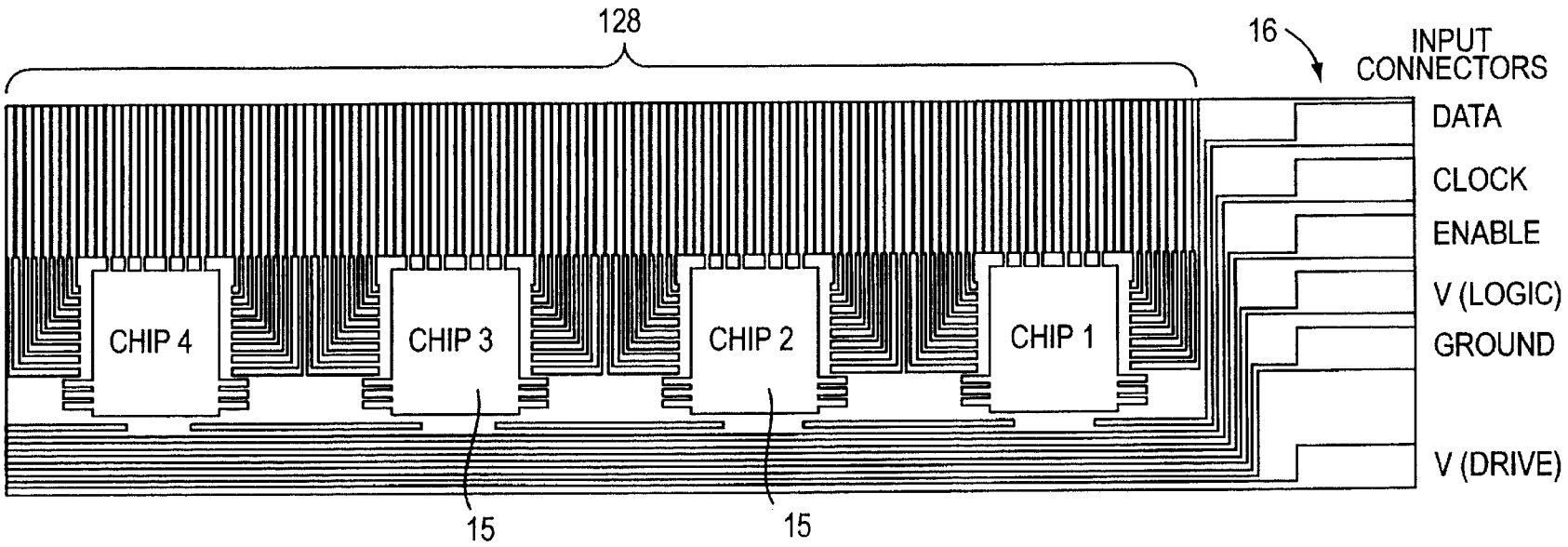

FIGS. 10A, B, & C illustrate the cycle of operation of the third printer by reference to cross-sectional views; and, FIG. 11 is a plan view of the third printhead on a smaller scale.

Figure 3:
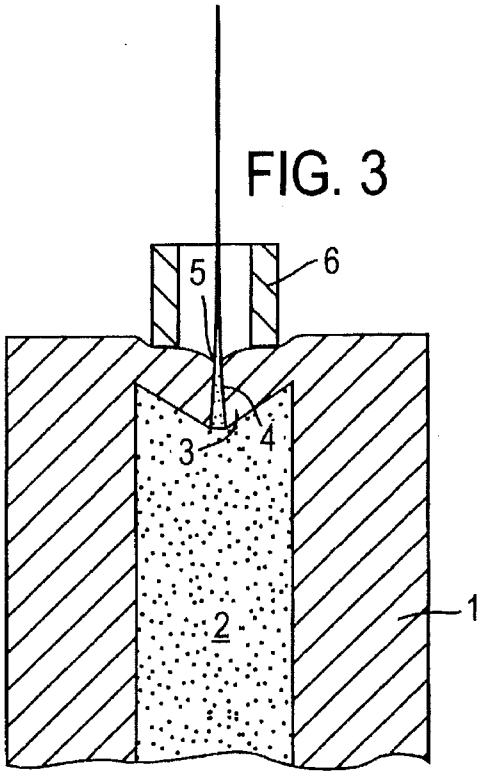
FIGS. 1, 2 and 3 illustrate cross-sections through a nozzle.
Figure 2:
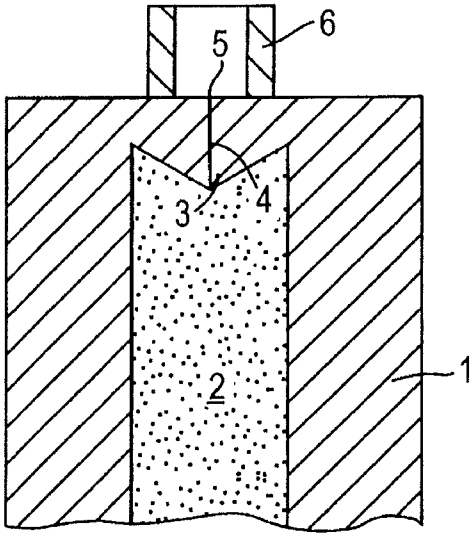
Figure 1:
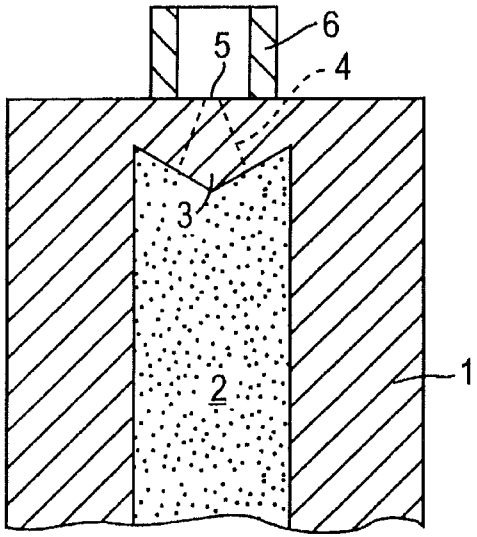

An embodiment of an ink jet printer, with valve closure by ink pressure, is shown in orthogonal sections through the printhead axis in FIGS. 1 and 2. The rubber component, 1, comprises a rigid cylindrical section containing the pressurised ink, 2, and integral conical end plug, 3. This is transected by a linearly tapering slit, 4, the outer aspect of which forms the orifice, 5. A rigid ring-like component forms the actuator, 6. Without load on the actuator, ink pressure forces the conical end plug to dish outwards, so sealing the slit. Pressure on the actuator against the end plug causes tension on the conical inner face which results in opening of the slit system. The opened slit is illustrated in FIG. 3. Alternatively, the actuator may be driven by magnetic elements or, when used in a pen, manually.

Figure 4:
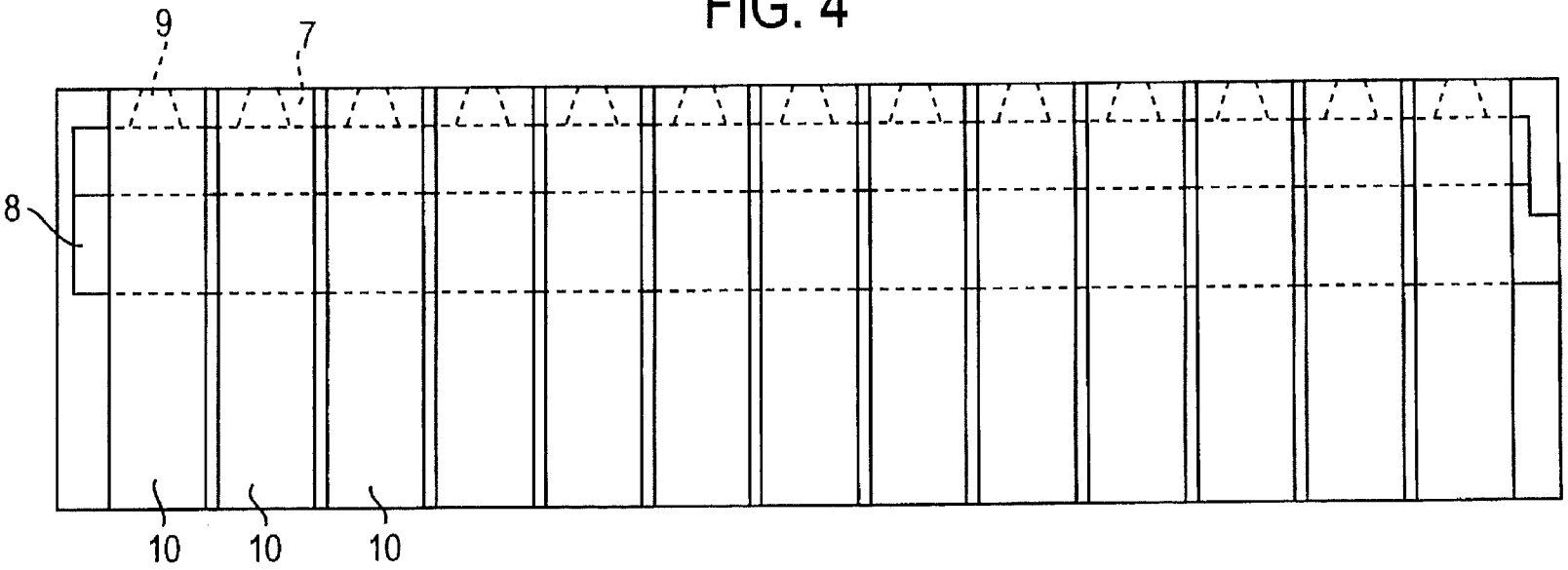
FIG. 4 illustrates a printer printhead in plan view.
Figure 5:
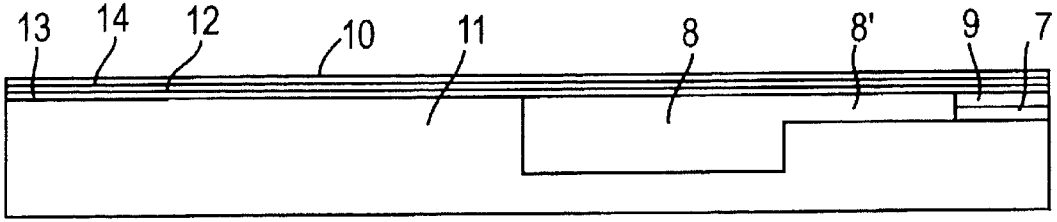
FIG. 5 illustrates the printhead in cross-section.

There are a number of embodiments appropriate for automated use, the exact design depending on the form of actuator used. FIGS. 4 and 5 illustrate a longitudinal and transverse section respectively through a printhead having an array of nozzles.

The rubber component 7 connects with a pressurised ink feed 8 and contains an array of nozzles in the form of tapered slits 9. The slits may conveniently be formed by transfixing the rubber component with a comb of piercing blades introduced through the ink feed 8.

FIGS. 4 and 5 illustrate a longitudinal and transverse section respectively through a printhead having an array of nozzles.

The printhead has a main body part 11 which may be formed, for example, of brass, the body part 11 being shaped so as to provide a large recess to form an ink chamber 8 and a smaller recess forming an extension 8' leading to a plurality of nozzles 9 in the form of tapered slits provided in an elastic (for example rubber or other elastomeric) component 7 which closes the end of the extension 8'.

A plurality of piezoelectric actuators 10 are disposed along the length of the body part 11, each actuator comprising an elongate piezoelectric ceramic layer 12 disposed on a metallic backing element 13. To close the chamber 8 a rubber seal 14, for example, may be provided across the top of the piezoelectric actuators. The rubber seal is not shown in FIG. 4. Alternative methods of sealing the chamber 8 may be used.

In the example shown, the nozzle spacing is approximately 0.25 mm and the length of the piezoelectric actuator about 7 mm. The rubber component 7 has a thickness of 10 μm. The printhead is assembled with a preload so that rubber component 7 is compressed by about 5 μm. This ensures that the slit valves are positively closed in their quiescent state. Changes in dimension of the printhead due to thermal expansion and solvent swelling or creep of the rubber can be accommodated so as to maintain the nozzle slit 9 closed under normal circumstances. The piezoelectric actuators have a displacement at the nozzles of about 30 μm which therefore enables an effective opening of about 20 μm in the rubber nozzles when operated.

It will readily be appreciated that a large number of nozzles can be accommodated in a very short length and it is envisaged that nozzle spacing may be as low as 0.1 mm.

Individual piezoelectric actuators 10 are connected to an electronic control so as to open and close individual slits under microprocessor control in accordance with an appropriate operating strategy.

Figure 6:
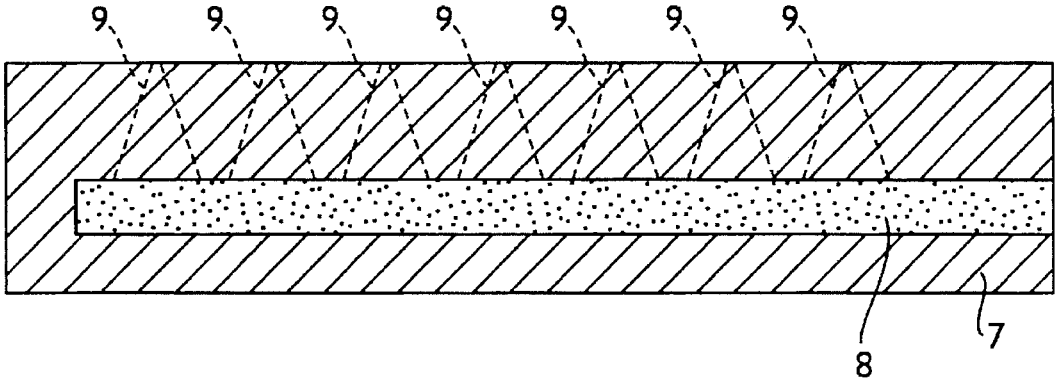
FIG. 6 illustrates a second printer printhead in plan view.
Figure 7:
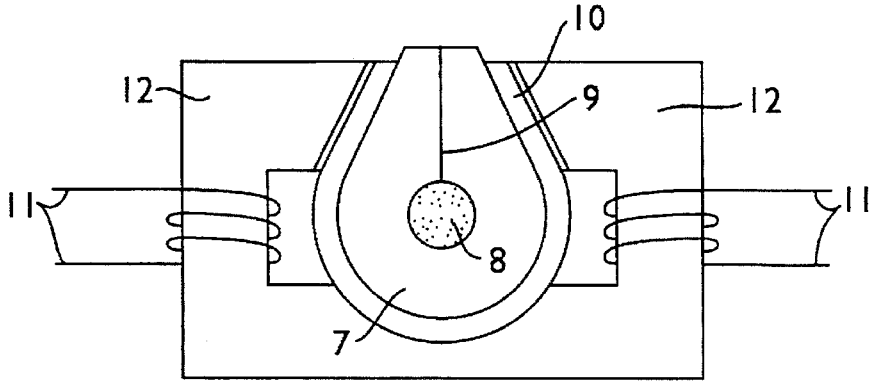
FIG. 7 illustrates the second printhead actuator assembly.

FIGS. 6 and 7 illustrate a longitudinal and transverse section respectively through a second printhead having an array of nozzles.

The rubber component 7 contains an integral pressurised ink feed 8 and an array of nozzles in the form of tapered slits 9. The slits maybe formed by transfixing the whole component with piercing blades and then sealing those through the end wall with appropriate adhesive. The actuator 10 is in the form of a spring clip bonded to the rubber component. The natural spring coupled with ink pressure generates compression to hold the valve closed. Energising the coils 11 generates magnetic forces via the yokes 12 which open the spring clip and hence the nozzle. Plural clips are provided, one in respect of each orifice/nozzle.

Figure 8:
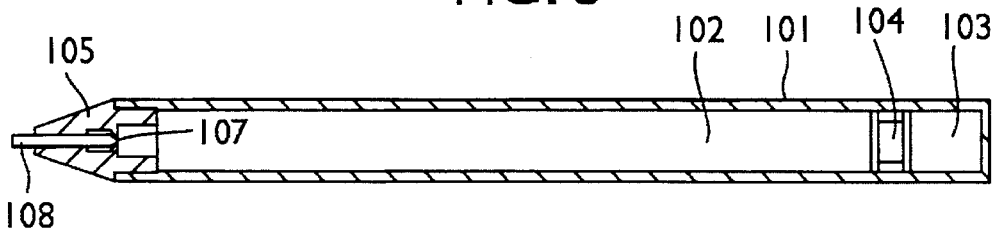
FIG. 8 shows an embodiment of a pen using the nozzle of the invention.

In the embodiment of the pen shown in FIG. 8, the ink is pressurised by a propelling agent which may take the form of gas dissolved under pressure in the ink or a solution of a low boiling point fluid in the ink. The solution of propellant in the ink may be retained in a porous element within the pen which connects hydraulically to the valve by capillary action. In this fashion leakage will probably avert spillage of ink and should result just in loss of propellant. Alternatively, the pressurising agent may be a low boiling point liquid floating on top of the ink, incorporated in an open cell sponge insert that preferentially absorbs the propellant. A further alternative is physical separation of the ink and a propelling fluid by a movable piston.

FIG. 8 shows the pen as a sagittal section through the axis of symmetry. The pen barrel 101 contains ink 102 pressurised by a low boiling point liquid 103 contained generally by a rubber piston 104. A rubber component 105 is inserted into the barrel 101 to seal the system and provide the orifice/nozzle assembly. The pen barrel 101 slides over the rubber component 105 providing radial pressure which keeps the orifice hole 107 closed. Pressure on the metal actuator 108 causes the sealing membrane to recede, so opening the orifice. The opening occurs from the inner surface outwards, thus providing full pressure at the orifice from the initial moment of opening. Conversely, the orifice/nozzle closes first from the outside, inhibiting the formation of any droplets of ink on the outer surface.

Figure 9:
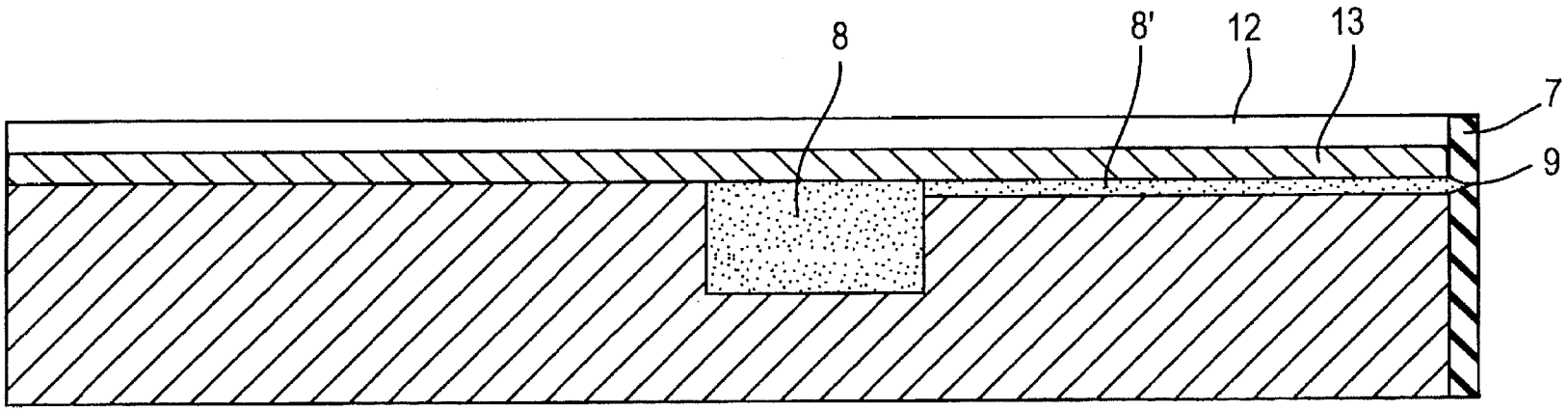
FIG. 9 shows a third printer printhead in cross-section.

The third printhead illustrated in FIGS. 9 through 11 is similar in construction to that of FIGS. 4 and 5 and the same reference numerals are used where appropriate.

The printer body 11 has a non-pressurised ink feed 8 with a plurality (in this example 128) ink channels 8' which are formed between the body 11 and respective Invar backing strips 13 on which piezoelectric ceramic unimorph elements 12 are mounted. A rubber closure component 7 is disposed at the end of the channels 8' to normally close the channels, the component 7 having an array of 128 nozzles in the form of tapered slits 9. The slits may conveniently be formed by transfixing the rubber component with a comb of piercing blades introduced through the ink feed 8 or from the exterior.

The body part 11 may be formed, for example, of brass, being shaped so as to provide a large recess to form the ink chamber 8 and smaller recesses forming the channels 8'.

In the example shown, the nozzle spacing is approximately 0.25 mm and the length of the piezoelectric actuator about 4 mm. The rubber component 7 has a thickness of 50 μm. The printhead may again be assembled with a preload so that the rubber component 7 is compressed appropriately.

Conveniently, a sandwich of slotted unimorph, piercing comb and printer body, may be impregnated with raw rubber which is then cured to form, in one operation, the channels with tapered ends, the hydraulic seals between actuators, isolating rubber walls between adjacent ink channels, and electrical insulation around the actuators. Subsequent external pressure may cause the cutting tips of the piercing comb to transfix the outer wall to produce the array of orifices. The unimorph may subsequently be bonded to the body with such a clearance as to provide the required residual compressive stress in the rubber.

As shown in FIG. 11, individual piezoelectric actuators 10 are connected in groups to an electronic control provided in part by a plurality of serial to parallel integrated circuit driver chips 15 so as to enable individual slits to open and close under microprocessor control in accordance with an appropriate operating strategy. By this means a single low voltage data line may drive the plurality of actuators, so removing the necessity for a very fine pitch, high voltage multi-way connector. The chips 15 are provided with appropriate inputs through edge connectors 16 as shown.

Figure 10B:
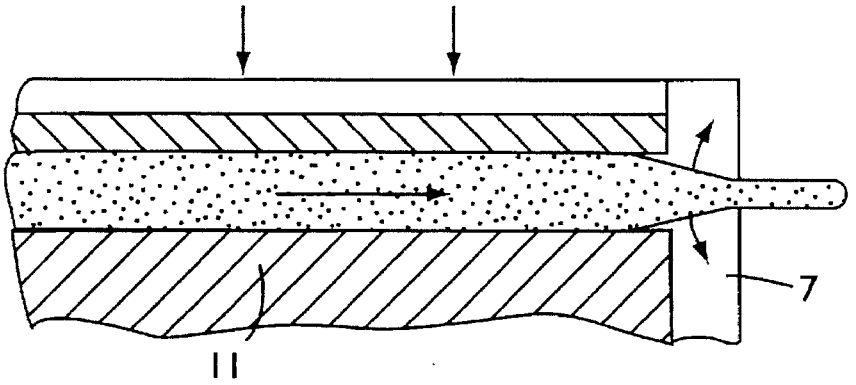
Figure 10C:
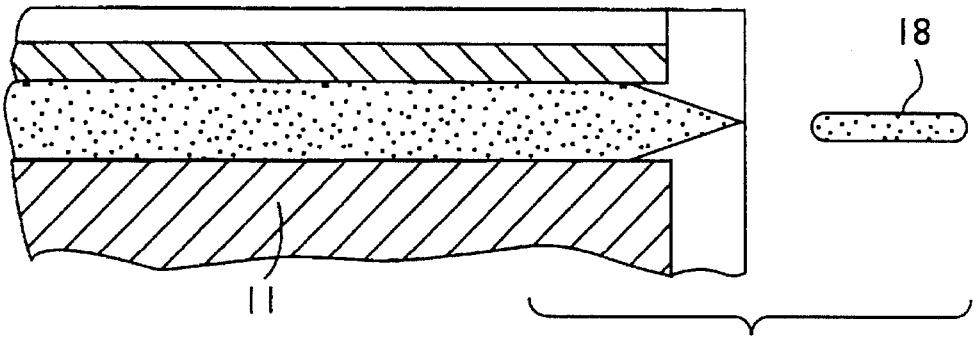

As FIGS. 10A–C show, the cycle of operation of an individual slit 9 starts with activation of the piezoelectric unimorph 12 which rises and draws ink 17 into the respective channel 8' from the ink feed chamber 8. The reduced pressure ensures that the slit 9 remains closed. The unimorph is then permitted to return so that the inrushing ink is decelerated to provide positive hydraulic pressure which opens the slit 9 and ejects ink from the nozzle. As the pressure drops, the nozzle closes to cut the flow of ejected ink 18. Cessation of flow occurs while the ink is still under significant pressure so that there is a clean cutoff with all the ejected ink travelling at virtually the same velocity. The unimorph then returns to its rest position.

The unimorph performance depends critically on the strength of the internal unimorph bond to shear stress. Most good adhesives are based on organic polymers which are fundamentally less rigid than the unimorph components. One solution to this problem is to roughen the glued surfaces and include within the adhesive an angular rigid powder of controlled grain size. Grains of the powder can locate within the roughness of the surfaces and jam under shear stress to provide a bond rigidity comparable with the included powder. The adhesive then serves just to hold the powder granules in place.

Due to the incompressibility of the ink, a small rapid deflection of the actuator may produce very high pressures. A volume of ink comparable with the volume displaced by the actuator will be exuded from the slit or nozzle. Some of this displaced ink will open the valve and the valve may be opened through a larger displacement than the maximum transducer displacement. The system therefore acts as a hydraulic magnifier.

Initial actuation of the unimorph to enlarge the slot 8' provides higher hydraulic pressures and greater ink displacement through the nozzle than simply depressing the unimorph to produce a pressure impulse. This advantage may be exploited by reducing the excitation voltage for lower power consumption or by reducing the unimorph length for higher frequency operation.

The rubber valve/nozzle may be formed externally to the unimorph/printer body assembly. This confers greater flexibility on the valve, eases the manufacturing tolerances and permits a modicum of solvent swelling of the rubber without unduly changing the mechanical characteristics of the assembly.

I claim:

1. In a drop-on-demand ink jet printer, the improvement comprising:

a combined nozzle and valve for jetting ink, the combined nozzle and valve comprising:

an elastic material formed with an orifice defined by a slit or hole through the elastic material, the elastic material being controllably deformable to cause the orifice to open without the elastic material contacting the surface; and means for preloading the elastic material in compression to maintain the orifice in a normally sealed configuration;

whereby said elastic material is deformable to cause the orifice to open.

2. A drop-on-demand ink jet printer, comprising:

an ink chamber for containing ink;

an elastic material at least partially bounding said ink chamber;

a closable orifice defined by a slit or hole through the elastic material for jetting ink therethrough in a pressurized stream of droplets, said elastic material being preloaded in compression and deformable to cause the orifice to close or to open for said jetting of ink; and an actuator for actuating the elastic material and operable to overcome said preloading in compression and cause said elastic material to deform so as to open or close the slit or hole.

3. An ink jet printer according to claim 2, wherein the ink chamber is externally pressurised.

4. An ink jet printer according to claim 2, wherein the ink chamber is pressurised in use by movement of the actuator.

5. An ink jet printer, comprising:

an ink chamber for containing ink;

an elastic material at least partially bounding said ink chamber;

a closable orifice defined by a slit or hole through the elastic material for jetting of ink therethrough for printing on a surface, said elastic material being deformable to cause the orifice to close or to open for said jetting of ink; and an actuator engaging the elastic material and operable to cause said elastic material to deform so as to open or close the slit or hole, wherein the actuator is a piezoelectric element.

6. An ink jet printer according to claim 5, wherein the nozzle/valve is external to the actuator and support members.

7. An ink jet printer according to claim 5, wherein the piezoelectric element is a piezoelectric unimorph.

8. An ink jet printer according to claim 6, wherein the piezoelectric element has a backing strip bonded thereto on a side adjacent the ink chamber.

9. An ink jet printer according to claim 5, having a plurality of closable slits or holes and respective actuators.

10. An ink jet printer according to claim 9, wherein the piezoelectric elements are in the form of a comb.

11. An ink jet printer according to claim 5, wherein the orifice in the elastic material is tapered to reduce loss of head through viscous drag effects.

12. An ink jet printer according to claim 5, having a plurality of closable slits or holes, a corresponding plurality of respective actuators and a corresponding plurality of ink channels each for channeling ink from the ink chamber to a respective one of said slits or holes, wherein the ink channels are hydraulically isolated by integral rubber partitions.

13. An ink jet printer according to claim 5, wherein the nozzle/valve in use opens from an inside face outwards and closes from an outside face inwards.

14. A method of operating an ink jet printer, having an ink chamber for containing ink; a closable orifice in a wall of the chamber through which a jet of ink is issued in use for printing on a surface, the orifice being formed by a slit or hole in an elastic material forming at least a portion of the chamber wall; and an actuator engaging the elastic material and operable to cause said elastic material to deform so as to open or close the slit or hole, the method including the step of operating the actuator to reduce the volume of the chamber.

15. A method according to claim 14, wherein the chamber is first expanded to cause an inflow of ink to the chamber.

* * * * *